US009279652B2

(12) United States Patent
Rahimi et al.

(10) Patent No.: US 9,279,652 B2
(45) **Date of Patent: *Mar. 8, 2016**

(54) SAFE AND ARM EXPLOSIVE TRAIN

(71) Applicant: Rafael Advanced Defense Systems Ltd., Haifa (IL)

(72) Inventors: Shai Rahimi, Kyriat Motzkin (IL); Evgenia Golda Fradkin, Yokneam Illit (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

This patent is subject to a terminal disclaimer.

(21) Appl. No.: 14/193,661

(22) Filed: Feb. 28, 2014

(65) Prior Publication Data

US 2014/0196624 A1 Jul. 17, 2014

Related U.S. Application Data

(63) Continuation of application No. 13/337,132, filed on Dec. 25, 2011, now Pat. No. 8,689,691.

(30) Foreign Application Priority Data

Dec. 26, 2010 (IL) ..... 210260

(51) Int. Cl.

| | |
|---|---|
| ***F42C 15/18*** | (2006.01) |
| ***F42C 15/184*** | (2006.01) |
| ***F42C 15/188*** | (2006.01) |
| ***F42C 15/28*** | (2006.01) |

(52) U.S. Cl.

CPC ..... *F42C 15/28* (2013.01); *F42C 15/18* (2013.01); *F42C 15/184* (2013.01); *F42C 15/188* (2013.01)

(58) Field of Classification Search

CPC ..... F42C 15/18; F42C 15/184; F42C 15/188; F42C 15/28

USPC ..... 102/221, 222, 223, 254, 229

See application file for complete search history.

(56) References Cited

U.S. PATENT DOCUMENTS

| | | | | |
|---|---|---|---|---|
| 6,220,164 | B1 | 4/2001 | Laucht et al. | |
| 6,984,274 | B2 * | 1/2006 | Hofmann et al. | 149/2 |
| 7,040,234 | B1 | 5/2006 | Maurer et al. | |
| 7,052,562 | B1 | 5/2006 | Stec, III et al. | |
| 7,069,861 | B1 | 7/2006 | Robinson et al. | |
| 7,322,294 | B1 * | 1/2008 | Laib | 102/254 |
| 7,793,592 | B2 * | 9/2010 | Hofmann et al. | 102/530 |
| 7,942,989 | B2 | 5/2011 | Sailor et al. | |
| 8,425,704 | B2 | 4/2013 | Currano et al. | |
| 8,689,691 | B2 * | 4/2014 | Rahimi et al. | 102/254 |

FOREIGN PATENT DOCUMENTS

DE 19815928 C2 * 5/2000

* cited by examiner

*Primary Examiner* — James S Bergin

(74) *Attorney, Agent, or Firm* — Burns & Levinson LLP

(57) ABSTRACT

A Safe-and-Arm system for the prevention of unintentional operation of an explosive device by interrupting a detonation train, the system employing an interruptive transfer assembly made of silicon and suitable for implementing in a MEMS device, the assembly including a silicon based transfer charge carrier on a porous explosive passageway made by etching, the passageway extending between at least two ports on the circumference of the transfer assembly, and a drive means that can mechanically bring about at least one armed state of a detonation train.

14 Claims, 5 Drawing Sheets

SAFE AND ARM EXPLOSIVE TRAIN

CROSS-REFERENCE TO RELATED APPLICATIONS

This application is a continuation of U.S. patent application Ser. No. 13/337,132, entitled "SAFE AND ARM EXPLOSIVE TRAIN," filed Dec. 25, 2011, which in turn claims the benefit of priority from Israel Patent Application No. 210260, filed Dec. 26, 2010, both of which are incorporated herein by reference in their entirety for all purposes.

FIELD OF THE INVENTION

The present invention relates to safe and arm devices usable in weapon systems to prevent unintentional activation of explosive elements.

BACKGROUND OF THE INVENTION

Safe and arm (S&A) systems typically provide for an interruptible explosive train between a pyrotechnic input and a pyrotechnic output in the safe condition and a contiguous explosive train located between the pyrotechnic input and the pyrotechnic output in the armed condition. A well accepted design which implements the above functionality includes a transfer charge assembly, such as a rotor or a slider, incorporating the pyrotechnic transfer charge. In the safe state of the S&A system, the transfer charge assembly inert structure constitutes a barrier between the input charge and the output charge, thereby interrupting the propagation of any pyrotechnical reaction from the input charge (if activated) to the output charge. In the arming process, the S&A system switches from safe state to armed state by movement of the transfer charge assembly. In the armed state, the transfer charge provides a pyrotechnic path from the input charge to the output charge. Specifically, the transfer charge serves as an acceptor for the pyrotechnic stimulus of the input charge, the reaction propagates through the transfer charge and the transfer charge further serves as a donor of the pyrotechnic stimulus to the output charge.

The transfer charge may consist of primary explosive or secondary explosive. A multitude of compositions for transfer charges and a multitude of corresponding manufacturing methods implemented therefor are known in the art, for example in U.S. Pat. Nos. 7,069,861, 7,052,562 and 7,040,234. Such methods include, but may be not limited to direct pressing or casting into the appropriate cavity and pre-forming the explosive pellet and mounting it into the cavity.

Micro-electromechanical systems (MEMS) are typically fabricated by employing the photo-lithography mask and etch techniques familiar to those in the semiconductor fabrication technology to form micro-miniature parts of silicon or other materials. An issue raised in U.S. Pat. No. 7,052,562, is that manufacturing of pyrotechnic charges for miniaturized S&A devices (such as MEMS-type systems) presents a special challenge, due to the small dimensions involved and the small quantity of materials involved. The filling of high explosives into very small cavities may be performed by wipe loading, pressure loading and syringe loading. A volatile mobile phase may be added to the slurry so as to partially dissolve the energetic material so that, upon evaporation of the mobile phase, the energetic material precipitates and adheres to the cavity to be filled with the explosive. The present invention provides a different method for providing explosive components, and in particular explosive train components for S&A devices.

BRIEF DESCRIPTION OF THE DRAWINGS

The invention may be understood upon reading of the following detailed description of non-limiting exemplary embodiments thereof, with reference to the following drawings, in which.

DETAILED DESCRIPTION OF THE INVENTION

In a device implementing the present invention, a transfer charge connecting between an input charge, such as an initiator or a lead and the output charge of a safe and arm (S&A) device is mechanically controlled to either bring about the detonation train to an interrupted (safe) or to a sequence enabled (armed) state. The interruption of the detonation train prevents the device from activating the output charge.

Figure 1A:
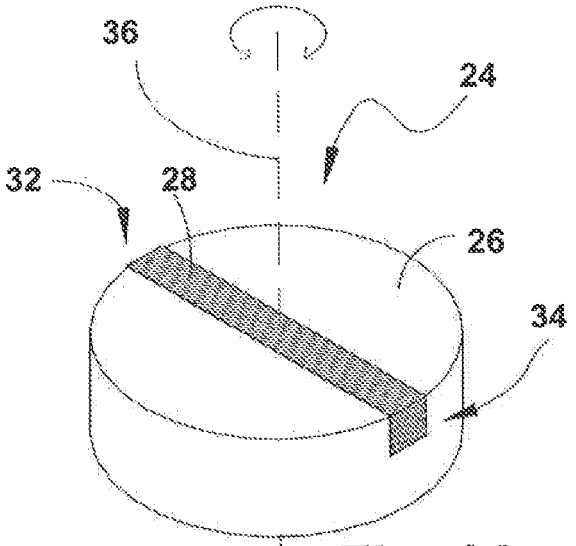
FIG. 1A is an isometric view of a rotatable transfer charge carrier in accordance with an embodiment of the invention.
Figure 1B:
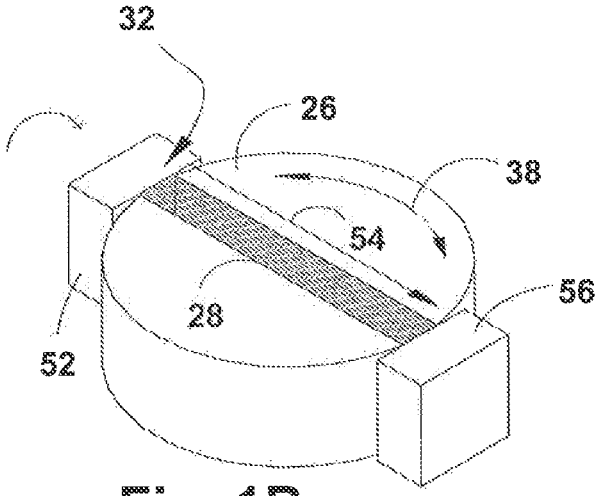
FIG. 1B is an isometric view of a rotatable transfer charge carrier in accordance with an embodiment of the invention showing the rotatable charge carrier and accompanying charges.
Figure 1C:
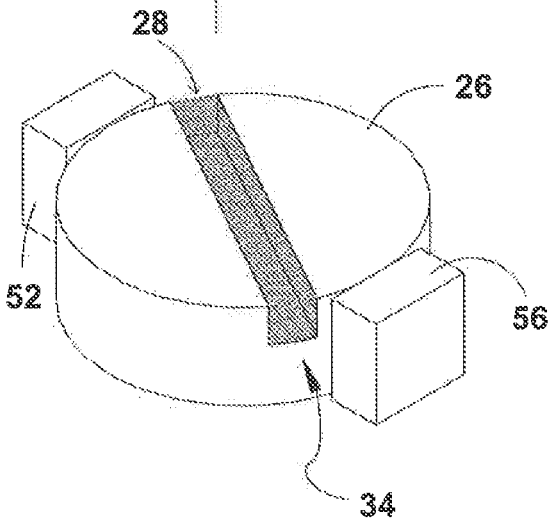
FIG. 1C is an isometric view of an interruptive transfer assembly in which a rotatable charge carrier demonstrates a state in which the porous passage is non-aligned with the accompanying charges.

Referring first to FIG. 1A-C, there is shown a part of a mechanical interruptive transfer assembly, in which a rotatable silicon based transfer charge carrier (TCC) 24 is maintained in either one of two states. First, in FIG. 1A, a schematic description of the rotatable transfer charge carrier (TCC) 24 is shown, detached from its functional environment. Disc 26 is traversed by an explosive porous passage (referred to hereinafter as EPP) 28 which is a defined volume within the silicon based TCC, having a porous structure, constituting a continuous channel from input port 32 to output port 34, at the respective ends of EPP 28. The EPP is a continuum of porous silicon impregnated with an oxidizer, thereby constituting a porous silicon explosive path. Disc 26 is rotatable around its axis of rotation 36, drawn in dashed line. In FIGS. 1B-C, to which reference is now made, two charges adjacent the TCC are shown, namely the input charge 52 and the output charge 56. Torque for rotation in the direction described by double headed arrow 38 is delivered to the disc by a drive means associated with a mechanical support layer, not shown. Electrical initiator, not shown here, is capable of activating input charge 52. The detonation wave passes from input charge 52 through input port 32 and the length of EPP 28, in the direction of arrow 54. The detonation wave moves along EPP 28, until it reaches output port 34 of EPP 28 abutting output charge 56. When the TCC is turned clockwise, for example, EPP 28 of disc 26 becomes non-aligned with charges 52 and 56 respectively if the rotation was carried far enough. The detonation train starting with charge 52 and otherwise continuing to charge 56 is now interrupted. This is the safe condition of the S&A device. It should be appreciated that in a S&A device the detonation train is kept in safe configuration until certain physical or logical events (such as munition launch acceleration, lapse of time, exit from launch tube), have occurred. Rotor rotation may be prevented until certain conditions are met and the electrically operated drive means may be activated only after some other conditions are met. According to the above description, turning the TCC counterclockwise by an angle corresponding to the angle between the EPP in safe condition and the line defined by charges 52 and 56, will cause the EPP 28 which in safe state is non-aligned with charges 52 and 56 to switch and become aligned with charges 52 and 56, thereby bringing the S&A into armed state. While in the armed state, the TCC can be rotated to bring about a safe state, in which the TCC is non-aligned with charges 52 and 56.

Port Non-Alignment with the Input and Output Charges

Figure 2A:
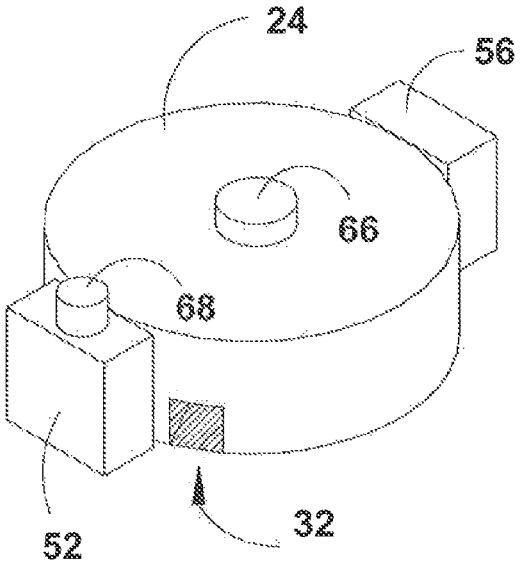
FIG. 2A is an isometric view of an interruptive transfer assembly showing the side facing the upper layer.
Figure 2B:
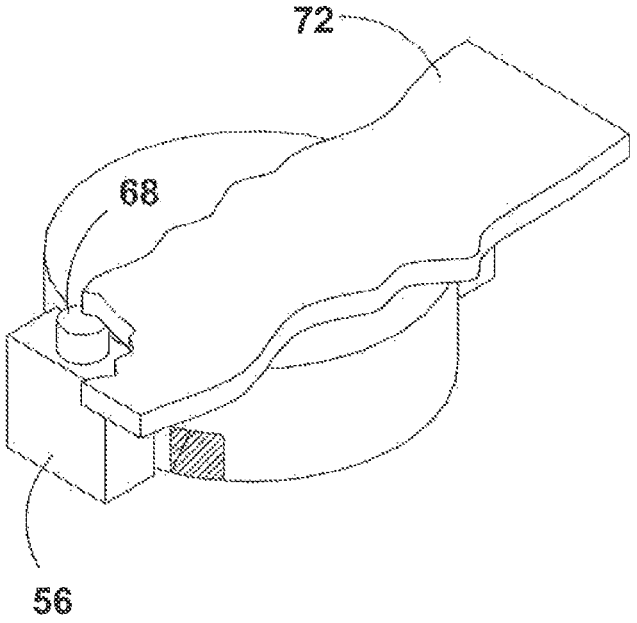
FIG. 2B is an isometric view of an interruptive transfer assembly showing the side facing the upper layer with part of the upper layer shown.
Figure 2C:
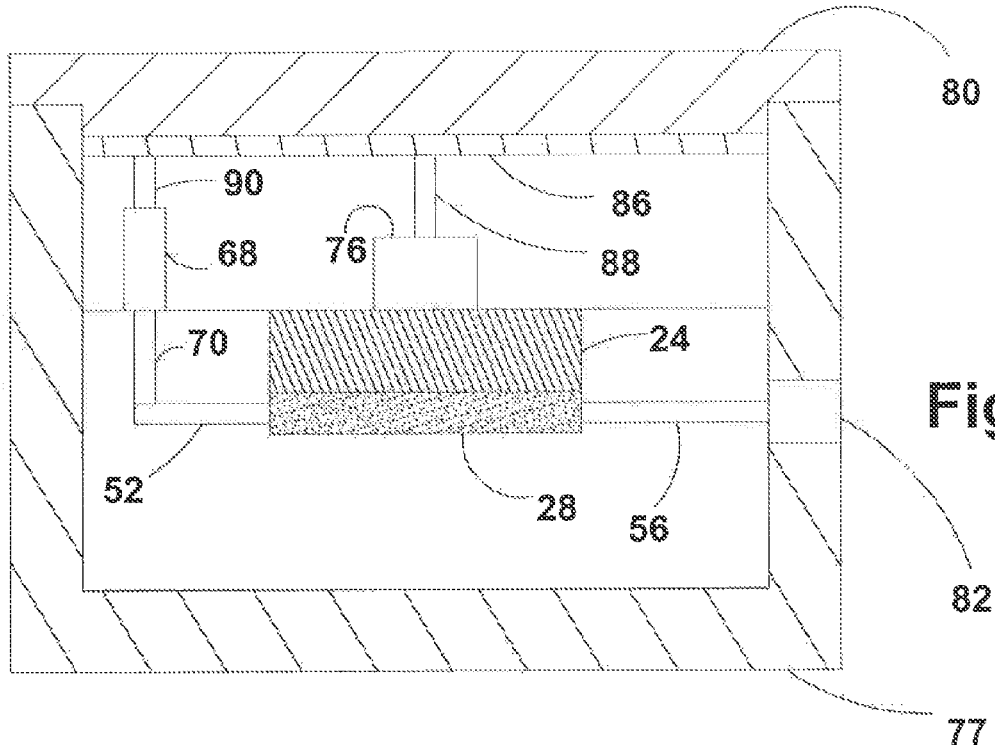
FIG. 2C is a cross sectional view of an S&A device accordance with an embodiment of the invention perpendicular to the rotation axis.
Figure 2D:
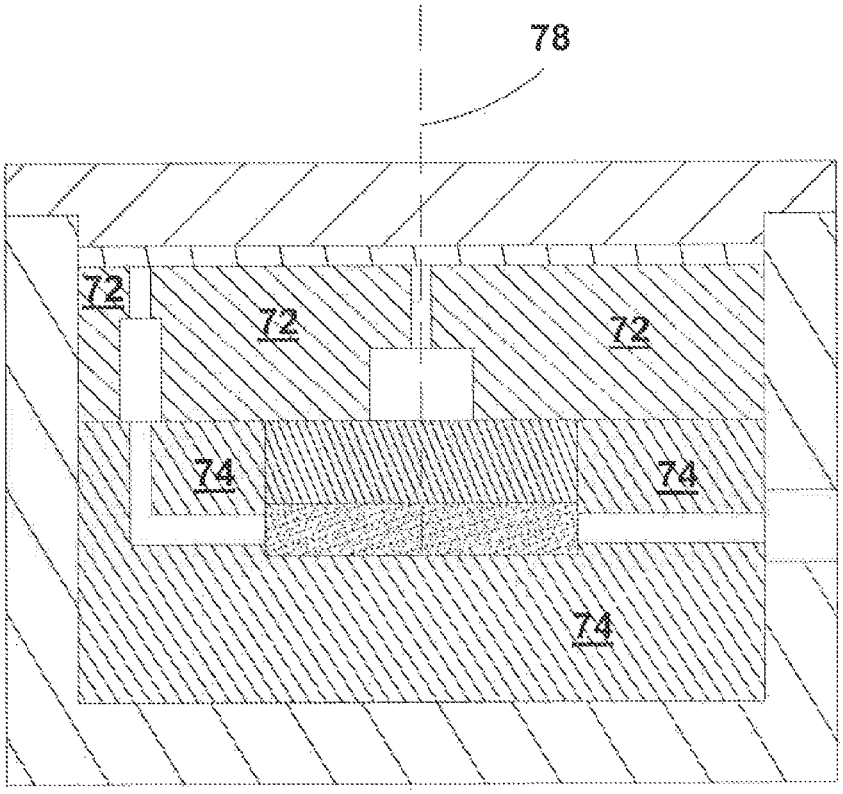
FIG. 2D is a cross sectional view of an S&A device as in FIG. 2C.

In FIGS. 2A-B, to which reference is now made, the TCC described above is shown from the other side, i.e. the side that faces the upper layer 72 (depicted in FIG. 2C). In this aspect TCC 24 reveals a pivot 66 which is used to transfer torque to TCC 24. The torque is provided by an actuator, such as a piezoelectric motor, not shown. In this figure initiating element (preferably electrical detonator) 68 is in a physical condition adequate to cause the initiation of input charge 52. Notably, electrical detonator 68 does not need to be in direct physical contact with input charge 52. Input charge 52 may receive its detonation stimulus through an air-gap, a layer of inner material such as a foil or an additional explosive element. Input charge 52 is non-aligned with EPP 28, of which only port 32 is shown. In FIG. 2B, a portion of the upper layer 72 is shown. The actuator that rotates pivot 66 is associated with upper layer 72, and also the conductors (not shown) that actuate electrical initiator 68 are applied on upper layer 72. The EPP should not necessarily be linear, it may assume a curved structure, notably arcuate, however, the shape should not impair the capability of the EPP to provide a continuous channel for the progress of the detonation through it. In FIGS. 2C-D, a sectional view through an assembled S&A device according to an embodiment of the invention is described. The S&A device include an electrical initiating element 68, which may be a miniature detonator or alternatively an electrical initiator chip. When activated, initiating element 68 activates an intermediate charge 70, which may consist of a primary explosive, such as by the way of example lead azide or lead styphnate or a secondary explosive such as HNS or CL-20, or a stack of primary and secondary explosives, typically loaded in a metal cup. Porous silicon based explosive could also be configured as primary or secondary intermediate charge. The intermediate charge 70 further activates an input charge 52 which may consist of a primary explosive, consists for example of lead azide or lead styphnate or a secondary explosive such as HNS or CL-20, or a stack of primary and secondary explosives, typically loaded in a metal cup. Porous silicon based explosive could also be employed as primary or secondary relay charge. The pyrotechnic output of the S&A device is provided by an output charge 56, which may consist of a secondary explosive such as by the way of example HNS or CL-20, typically loaded in a metal cup. Porous silicon based explosive could also be configured as secondary output charge. The transfer charge carrier assembly includes a rotor 24 incorporating EPP 28. The TCC's inert silicon structure constitutes a barrier between the input charge 52 and the output charge 56, thereby interrupting the propagation of any pyrotechnical reaction from the input charge (if activated) to the output charge. In the armed state, the EPP provides a pyrotechnic path from the input charge to the output charge. Specifically, the EPP serves as an acceptor for the pyrotechnic stimulus of the input charge 52, the reaction propagates through the EPP which further serves as a donor of the pyrotechnic stimulus to the output charge 56. The rotor is disposed within a cavity in the base layer 74. Intermediate charge 70, input charge 52 and output charge 56 are disposed typically inside base layer 74 as can be seen in FIG. 2D. Upper layer 72 accommodates the initiating element 68 and the rotary actuator 76, having an axis of rotation designated 78. This actuator may be a miniature motor as taught by example in U.S. Pat. No. 7,480,981. Using another terminology, it is an electrically operated drive means. Actuator 76 engaged with rotor 24. Base layer 74 and upper layer 72 are encased in S&A unit casing 77 and covered by cover 80. The casing 77 may include an embedded transfer charge 82, made of a secondary explosive material, such as a Cl-20 compound or HNS, in order to conveniently connect the output charge 56 with further stages in the pyrotechnic train, disposed externally to the S&A device. As the upper layer 72 has two electrically activated elements incorporated (initiating element 68 and rotary actuator 76), it is provided with a contacts layer 86, which is typically a printed circuit board or a layer of contacts deposited on the upper layer 72 for example by vapor deposition process. The contacts layer is connected to an electrical system outside the S&A device by means well known in the art, such as an electrical harness or connector, not shown. The electrical system outside the S&A controls the arming and the activation of the S&A device by supplying current to the rotary actuator and the detonator, through conductors 88 and 90 respectively.

Figure 3A:
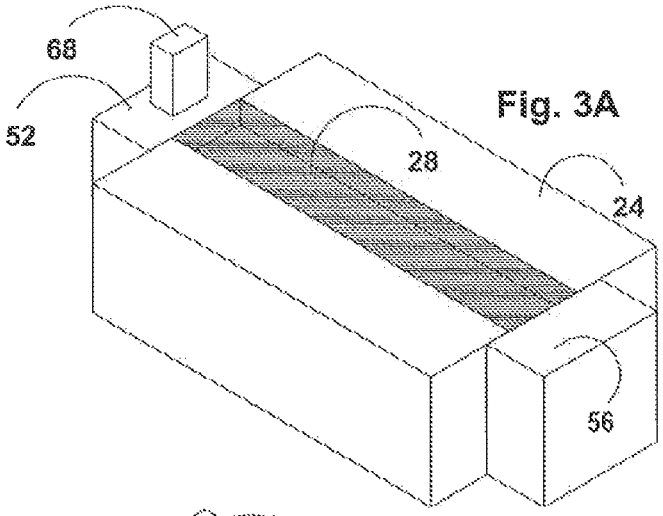
FIG. 3A is an isometric view of an interruptive transfer assembly in which a slidable charge carrier demonstrates a state in which the porous passage is aligned with the accompanying charges.
Figure 3B:
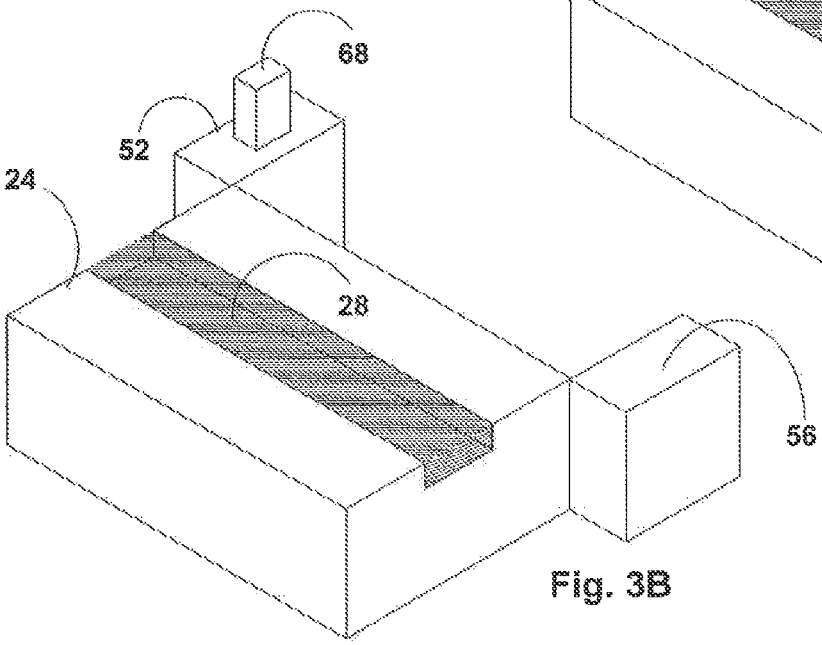
FIG. 3B is an isometric view of an interruptive transfer assembly in which a slidable charge carrier demonstrates a state in which the porous passage is non-aligned with the accompanying charges.

In another embodiment of the invention, the EPP is a part of a transfer charge carrier, somewhat different than the TCC described above. The TCC in this case is shifted from a safe S&A to an armed S&A state linearly rather than rotationally. As can be seen in FIG. 3A, electrical detonator 68, attached to input charge 52 abuts input port of EPP 28. The EPP is formed as a channel in TCC 24 having two external ports. Output charge abuts the output port of EPP 28. This configuration displays an uninterrupted detonation train, starting at the electrical detonator and ending in the output charge, or in other words, the S&A is armed. A safe configuration of the S&A in such an embodiment is described with reference to FIG. 3B. TCC 28 is now shown shifted relative to the input and output charges, causing the succession of charges to be discontinued. In this embodiment the armed S&A state is switched to the armed S&A state by linear shifting of the TCC effected by a drive means, rather than by rotation of the TCC as in the previously described embodiment. Switching to the safe state can be effected by a reverse shift of the TCC.

EPPs with More than Two Ports

Figure 4:
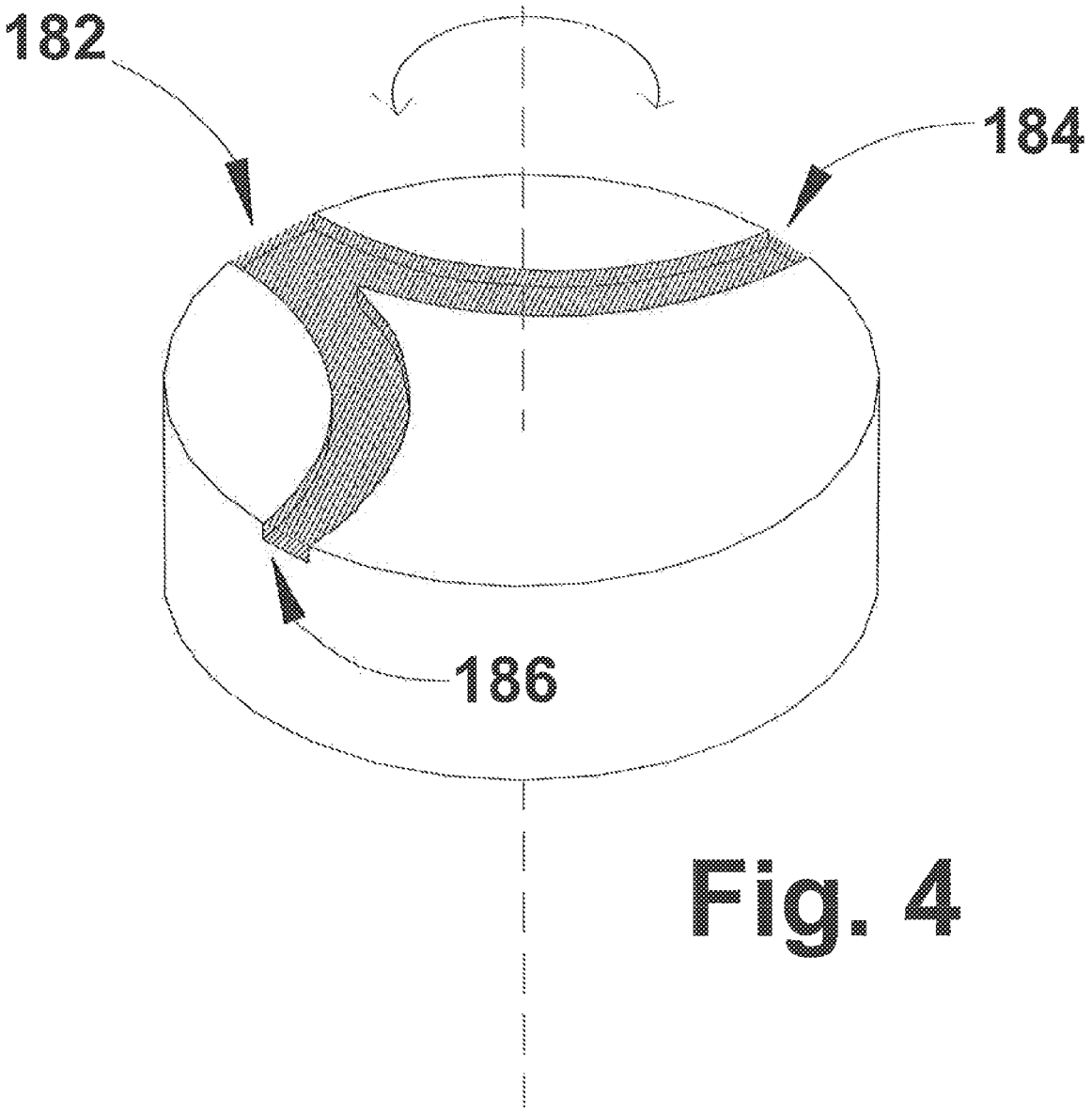
FIG. 4 is an isometric view of an interruptive transfer assembly showing a rotatable charge carrier having a bifurcated porous passage.

In FIG. 4, to which reference is now made, a TCC is shown, embodying a different configuration of porous passage distribution on the surface of the TCC. Port 182 is an input port, while ports 184 and 186 are both output ports. In this embodiment the EPP bifurcates. The detonation train beginning at an initiator near input port 182, bifurcates and further on reaches two separate output ports, namely output port 184 and output port 186. Each output port potentially can deliver the detonation train to a different output charge, thus providing two separate outputs resulting from one common input. In a two completely separate EPPs are embodied into the TCC, without intersecting. This arrangement corresponds to a two-inputs—two outputs system architecture. In yet another architecture, two separate input port can support and to activate a single output, thereby to allowing for redundancy of the detonation train. In all embodiments of the invention, the EPP, one or more, extend between ports on the circumference of the TCC.

It should be noted that the TCC has been hitherto described graphically as a circle, there is however no a-priori functional exclusion of the TCC assuming other geometrical shapes, such square shapes or other polygonal bodies are employed.

Porous Silicon as an Explosive

As disclosed in U.S. Pat. No. 6,984,274 for example in column 2 lines 54-59, porous silicon can be used as an explosive in combination with an oxidizing agent. Silicon as such is a rather reactive element, which readily oxidizes by oxidizing agents. Porous silicon is more reactive than non-porous silicon because of the increased surface area that can be exposed to the oxidizing agent. In accordance with the present invention, the TCC is produced as a part of a MEMS (micro electromechanical system) as will be explained in more detail later on. At this point it is sufficient to say that MEMS devices are commonly micro-fabricated on silicon substrates. The porous silicon based explosive is a combination of oxidizable substrate and an oxidizer. The fuel is porous silicon, with pore sizes in the nanometric range while the oxidizer is any strong oxidizer selected from the group of peroxides, nitrates or perchlorates. The nanometric pore size of the porous silicon fuel leads to a high specific surface area (up to 1000 $m^2/cm^3$). Due to the high specific area of the porous fuel, a stoichiometric mixture of the interacting active groups can be achieved, that will create an explosive reaction upon detonation. The fabrication facility and process of porous silicon based explosive is compatible with MEMS fabrication methods, thus enabling manufacturing of the explosive as an integral element of the MEMS system. The fabrication process of porous silicon based explosive is described in further details in U.S. Pat. Nos. 6,984,274 and 6,803,244 and in US Patent applications 200183109 and 200244899.

Preparing the Explosive Porous Passage

To form one or more EPPs, linear or bent or bifurcated, on the TCC, electrochemical etching is applied typically with hydrogen fluoride as the active agent. First masking is applied, i.e. patterning of an external HF resistive mask layer on top of the silicon wafer. Following, electrochemical etching of the silicon in the unmasked area in a highly concentrated HF solution is performed. When the porous passage is prepared, a passivation stage is effected to prevent the porous passage to react uncontrollably. Such passivation is brought about by one of several means, such as disclosed in U.S. Pat. No. 6,803,244. From this stage on, there are two approaches for preparing the EPP, in one approach referred to hereinafter as the "dry embodiment", following the passivation, an oxidizer, such as peroxide, nitrate or perchlorate is impregnated into the pores. The oxidizer is typically introduced solubilized in a solvent, after which the solvent is evaporated leaving the oxidizer in the porous silicon. The oxidizer can react with the porous silicon in the EPP when the combination porous silicon-oxidizer is initiated by the detonated input charge. In another approach, impregnation by an oxidizer is not performed after passivation and the Safe- and Arm device is assembled with the porous package in a non-explosive condition. Only when there is an arming command issued to the Safe-and-Arm device, the oxidizer is provided to the passivated non-impregnated porous passage by pouring a liquid oxidizer through a suitable conduit. The flow through the conduit is controlled by a valve that is electrically operated by a drive means initiated by receiving an electronic command signal and/or power transmitted typically through conductors of the MEMS device.

Safe and Arm States and Their Control

There are two approaches for realizing a S&A device in accordance with the invention. One approach, dwelt upon in detail, is the "dry approach", which relates to rotating the EPP from a non-aligned state to the aligned state. For example, the electrically operated drive means engaged with the TCC, may receive a control command and/or power to rotate such that the EPP ports become aligned with the accompanying charges, thereby forming a functional detonation train. The S&A device therefore switches from the safe to the armed state by turning. This turning brings about a mechanical predisposition of the S&A device to the armed state. In the other approach, the "wet approach", the arming of the S&A device is brought about by impregnating a passivated non-oxidized porous passage with a suitable type and amount of oxidizer, thereby turning it into a EPP and thus predisposing it to detonation. The flow of a liquid oxidizer out of a storage container is controlled by a an electrically operated valve, such that when given an appropriate electronic command signal and power, the drive means of the valve operates to open the passageway, the conduit connecting the storage container with the porous passage is allowed thereafter to convey the liquid to the porous passage, thereby impregnating the porous passage in the TCC and thus turning it into an EPP and predisposing it for detonation. Such a flow brings about a predisposition of the S&A device to the armed state. This embodiment, based on in-situ impregnation, obviates the mechanical shifting of the TCC. However, a combination of the two approaches, namely the dry approach S&A together with the in-situ impregnation, is also feasible.

What is claimed is:

1. A mechanical interruptive transfer assembly for a Safe-and-Arm system, the mechanical interruptive transfer assembly comprising:

a linearly shiftable transfer charge carrier comprising silicon, the linearly shiftable transfer charge carrier defining a continuous channel from an input port at the perimeter of the transfer charge carrier to an output port at the perimeter of the transfer charge carrier, wherein the continuous channel comprises porous silicon impregnated with an oxidizer.

2. The mechanical interruptive transfer assembly of claim 1, wherein the linearly shiftable transfer charge carrier is non-circular in shape.

3. The mechanical interruptive transfer assembly of claim 2, wherein the oxidizer is a peroxide, a nitrate, a perchlorate, or combinations thereof.

4. A Safe-and-Arm system, the system comprising:

the mechanical interruptive transfer assembly of claim 3, at least one input charge associated with the input port; and at least one output charge associate with the output port.

5. The Safe-and-Arm system of claim 4, further comprising at least one detonation initiator associated with the at least one input charge.

6. A Safe-and-Arm system, the system comprising:

the mechanical interruptive transfer assembly of claim 2, at least one input charge associated with the input port; and at least one output charge associate with the output port.

7. The Safe-and-Arm system of claim 6, further comprising at least one detonation initiator associated with the at least one input charge.

8. The mechanical interruptive transfer assembly of claim 1, wherein the oxidizer is a peroxide, a nitrate, a perchlorate, or combinations thereof.

9. A Safe-and-Arm system, the system comprising:

the mechanical interruptive transfer assembly of claim 8, at least one input charge associated with the input port; and at least one output charge associate with the output port.

10. The Safe-and-Arm system of claim 9, further comprising at least one detonation initiator associated with the at least one input charge.

11. A Safe-and-Arm system, the system comprising:

the mechanical interruptive transfer assembly of claim 1, at least one input charge associated with the input port; and at least one output charge associate with the output port.

12. The Safe-and-Arm system of claim 11, further comprising at least one detonation initiator associated with the at least one input charge.

13. The mechanical interruptive transfer assembly of claim 1, wherein porous silicon of the continuous channel is derived from the silicon of the linearly shiftable transfer charge carrier.

14. The mechanical interruptive transfer assembly of claim 13, wherein the porous silicon of the continuous channel is etched silicon of the linearly shiftable transfer charge carrier.

* * * * *